US008141984B2

(12) United States Patent
Iwanaga

(10) Patent No.: US 8,141,984 B2
(45) Date of Patent: Mar. 27, 2012

(54) LIQUID DISCHARGE SUBSTRATE AND LIQUID DISCHARGE HEAD INCLUDING THE SAME

(75) Inventor: Shuzo Iwanaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 12/477,764

(22) Filed: Jun. 3, 2009

(65) Prior Publication Data

US 2009/0303293 A1 Dec. 10, 2009

(30) Foreign Application Priority Data

Jun. 4, 2008 (JP) ..... 2008-146694

(51) Int. Cl.
*B41J 2/14* (2006.01)

(52) U.S. Cl. ..... 347/50; 347/57; 347/58; 347/59

(58) Field of Classification Search ..... 347/57–59, 347/50

See application file for complete search history.

(56) References Cited

U.S. PATENT DOCUMENTS

| | | | | |
|---|---|---|---|---|
| 4,791,440 | A * | 12/1988 | Eldridge et al. | 347/58 |
| 6,123,410 | A * | 9/2000 | Beerling et al. | 347/42 |
| 2007/0285469 | A1 * | 12/2007 | Sato et al. | 347/63 |
| 2008/0129791 | A1 * | 6/2008 | Furukawa et al. | 347/58 |

FOREIGN PATENT DOCUMENTS

| | | |
|---|---|---|
| EP | 1874543 | 1/2008 |
| WO | 2006-112526 | 10/2006 |

* cited by examiner

*Primary Examiner* — Matthew Luu
*Assistant Examiner* — Henok Legesse
(74) *Attorney, Agent, or Firm* — Canon USA Inc IP Division

(57) ABSTRACT

A liquid discharge substrate includes a first substrate having an element, on a first surface, that generates energy for discharging liquid; a plurality of first electrodes electrically connected to the element and passing from the first surface to a second surface of the first substrate opposite to the first surface; a second substrate that is in contact with the second surface to support the first substrate; and second electrodes provided between the first substrate and the second substrate and electrically connected to the plurality of first electrodes.

9 Claims, 10 Drawing Sheets

LIQUID DISCHARGE SUBSTRATE AND LIQUID DISCHARGE HEAD INCLUDING THE SAME

BACKGROUND OF THE INVENTION

1. Field of the Invention

The present invention relates to a liquid discharge substrate and a liquid discharge head including the same.

2. Description of the Related Art

A typical liquid discharge system for a liquid discharge head mounted in a liquid recording apparatus that performs recording by discharging liquid, such as ink, uses electrothermal transducers as elements that generate energy for discharging the liquid. The electrothermal transducers generate heat by converting electric energy to thermal energy when an electric control signal for recording is sent thereto. In this system, electrothermal transducers are disposed in the vicinity of the individual discharge ports, and liquid in the vicinity of the electrothermal transducers are heated by the electrothermal transducers and are boiled instantly to generate bubbling pressure, so that the liquid in the vicinity of the discharge ports is discharged through the discharge ports. Thus, a recording medium opposing to the discharge port is subjected to recording.

Such a liquid discharge head generally includes a liquid discharge substrate having a liquid supply port and a support substrate that supports the liquid discharge substrate. The liquid discharge substrate has, on the front surface thereof, a plurality of electrothermal transducers arranged in order and a flow-passage forming member having bubbling chambers that accommodate the individual electrothermal transducers and discharge ports that communicate the bubbling chambers with external space. The individual bubbling chambers communicate with the corresponding ink supply ports.

The front surface of the liquid discharge substrate has electrode terminals and electrodes. The electrode terminals are electrically connected to the electrothermal transducers etc. through the electrodes. The liquid-discharge-head main body transmits electric control signals and supplies driving power to the liquid discharge substrate using an electric circuit of the support substrate that is electrically connected to the electrode terminals on the liquid-discharge substrate.

Since recent ink-discharge recording apparatuses fall in price, manufacturing costs of the liquid discharge heads need to be reduced. To this end, it is considered to make the liquid discharge substrate compact to increase the number of the liquid discharge substrates obtained from one wafer.

However, making the liquid discharge substrate compact reduces the area of the front surface of the liquid discharge substrate on which electrodes can be disposed, which needs to decrease the width of the electrodes. This increases the resistance of the liquid discharge substrate, making it difficult to obtain sufficient power to drive the electrothermal transducers etc. Although the resistance can be reduced by forming thick electrodes, forming the thick electrodes may have problems when forming a flow-passage forming member on the electrodes.

As a method for solving the above problems, through electrodes that pass through the liquid discharge substrate from the back to the front can be proposed. This allows transmission of electric control signals and supply of driving power to the electrothermal transducers etc. formed on the liquid discharge substrate even if part of the electrodes is formed on the back surface of the liquid discharge substrate.

Since the back surface of the liquid discharge substrate is not provided with the electrothermal transducers etc., so that it has a wide area in which electrodes can be disposed, allowing the electrodes to be made wide. Moreover, since the flow-passage forming member is not formed on the electrodes, the electrodes can be made wide. Providing the through electrodes in the liquid discharge substrate in this way can reduce the resistance of the liquid discharge substrate by changing the width or thickness of the electrodes.

Since such a liquid discharge substrate has electrodes formed on the back surface thereof, the electrode terminals of the electrodes are generally provided on the back surface.

PCT International Publication No. WO2006/112526 describes a liquid discharge head fitted with a liquid discharge substrate having electrode terminals on the back surface thereof. FIG. 13 is a cross-sectional view showing electrical connecting portions between the liquid discharge substrate and the support substrate of the liquid discharge head and the vicinity thereof.

The liquid discharge head includes a liquid discharge substrate 100 having an ink supply port 102 and a support substrate 200 having three-dimensional wiring. The support substrate 200 is formed of layered ceramic sheets 201 and has connecting pads 202 on the front surface of the support substrate 200. On the back surface of the liquid discharge substrate 100, electrode terminals 111 are provided. The connecting pads 202 on the support substrate 200 and the electrode terminals 111 on the liquid discharge substrate 100 are electrically connected through bumps 205. Thus, transmission of electric control signals and supply of driving power from the liquid-discharge-head main body to the liquid discharge substrate 100 are performed.

Furthermore, electrical connecting portions in which the connecting pads 202 and the electrode terminals 111 are connected with the bumps 205 are provided. The clearance between the liquid discharge substrate 100 and the support substrate 200 is sealed by a sealing member 206. This prevents leakage of ink from between the liquid discharge substrate 100 and the support substrate 200 and electrical problems due to contact of the electrical connecting portions with ink.

Although the sealing technique of the electrical connecting portions disposed between the two substrates with a sealing member is generally used in various devices, sufficient sealing can generally be achieved by sealing the entire substrates including the electrical connecting portions with a sealing member.

However, the liquid discharge head shown in FIG. 13 is provided with the ink supply port 102 in the proximity of a portion at which the sealing member 206 is disposed. Therefore, if the sealing member 206 enters the ink supply port 102, it hinders supply of ink. Therefore, an excessive amount of the sealing member 206 cannot be disposed between the liquid discharge substrate 100 and the support substrate 200.

On the other hand, if the amount of the sealing member 206 is insufficient, the electrical connecting portions disposed in the proximity of the ink supply port 102 are not sufficiently sealed, so that ink comes into contact with the electrical connecting portions, thus sometimes causing electrical problems.

Thus, this liquid discharge head needs accurate sealing of the very small portion, which makes it impossible to improve the reliability and manufacture yields. Moreover, reducing the size of the liquid discharge substrate decreases the portion to be sealed by the sealing member, which makes it more difficult to achieve accurate sealing.

SUMMARY OF THE INVENTION

The present invention provides a liquid discharge substrate with low resistance and which improves reliability.

A liquid discharge substrate according to an aspect of the present invention includes a first substrate having an element, on a first surface, that generates energy for discharging liquid; a plurality of first electrodes electrically connected to the element and passing from the first surface to a second surface of the first substrate opposite to the first surface; a second substrate that is in contact with the second surface; and second electrodes provided between the first substrate and the second substrate and electrically connected to the plurality of first electrodes.

The present invention can provide a liquid discharge substrate with low resistance and which improves reliability, as well as a liquid discharge head including the same.

Further features of the present invention will become apparent from the following description of exemplary embodiments with reference to the attached drawings.

DESCRIPTION OF THE EMBODIMENTS

Embodiments of the present invention will be described with reference to the drawings.

First Embodiment

Figure 1:
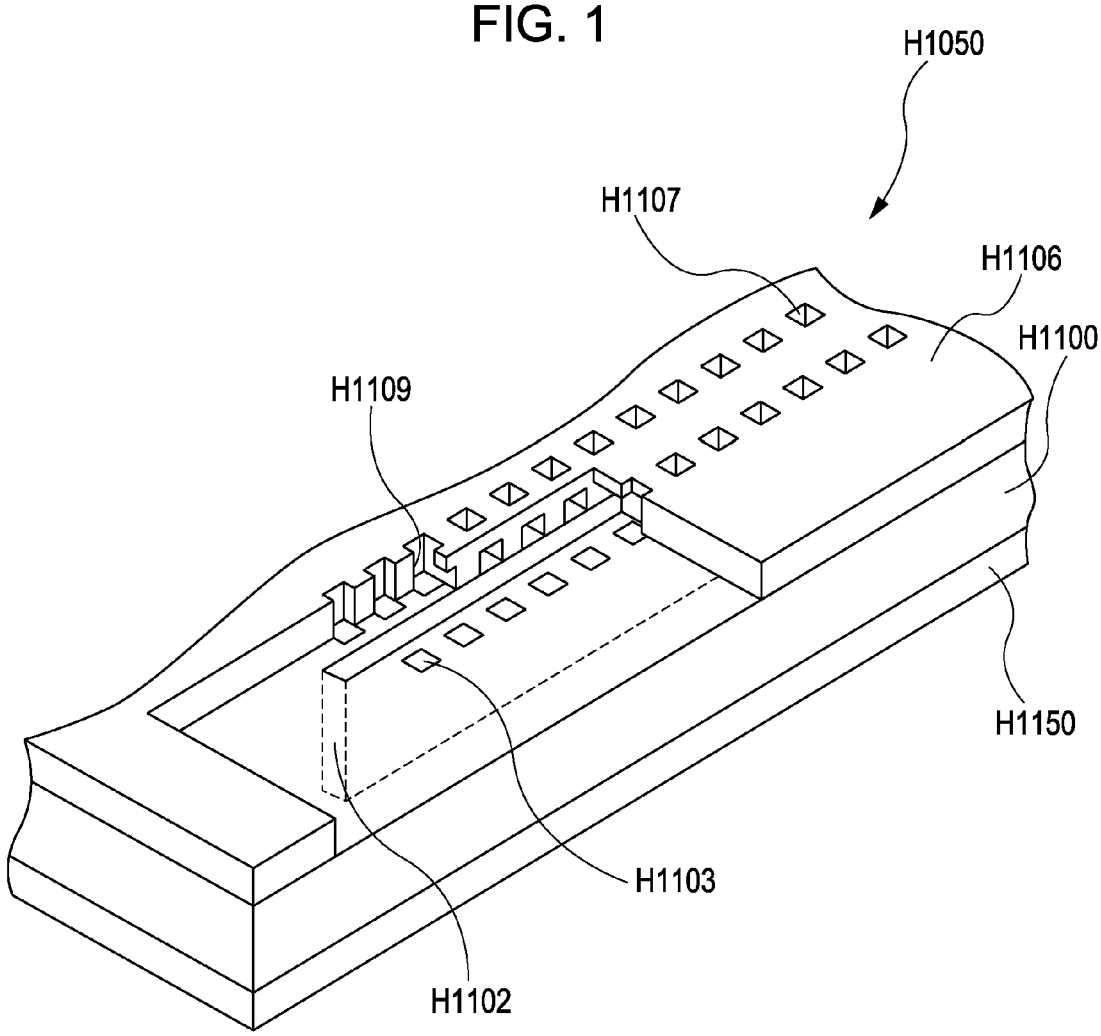
FIG. 1 is a perspective view of an ink-discharge substrate unit according to a first embodiment of the invention.

Referring first to FIGS. 1 to 4, an ink-discharge substrate unit used as a liquid discharge substrate will be described. FIG. 1 is a perspective view of an ink-discharge substrate unit H1050 according to a first embodiment of the invention.

The ink-discharge substrate unit H1050 includes an ink discharge substrate H1100, which is a silicon substrate, used as a first substrate and a cover substrate H1150 used as a second substrate. Furthermore, the ink-discharge substrate unit H1050 includes a flow-passage forming member H1106 formed on the front surface used as a first surface of the ink discharge substrate H1100. The cover substrate H1150 is in close contact with a back surface that is a second surface opposing the first surface of the ink discharge substrate H1100.

The ink discharge substrate H1100 has an ink supply port H1102 in the central region. Furthermore, the front surface of the ink discharge substrate H1100 has a plurality of electrothermal transducers H1103 used as elements for generating energy for discharging liquid. The front surface of the ink discharge substrate H1100 further has bubbling chambers H1109 that accommodate the individual electrothermal transducers H1103 and discharge ports H1107 that communicate the bubbling chambers H1109 with external space, which are made of the flow-passage forming member H1106. The bubbling chambers H1109 are communicated with the ink supply port H1102.

Figure 2:
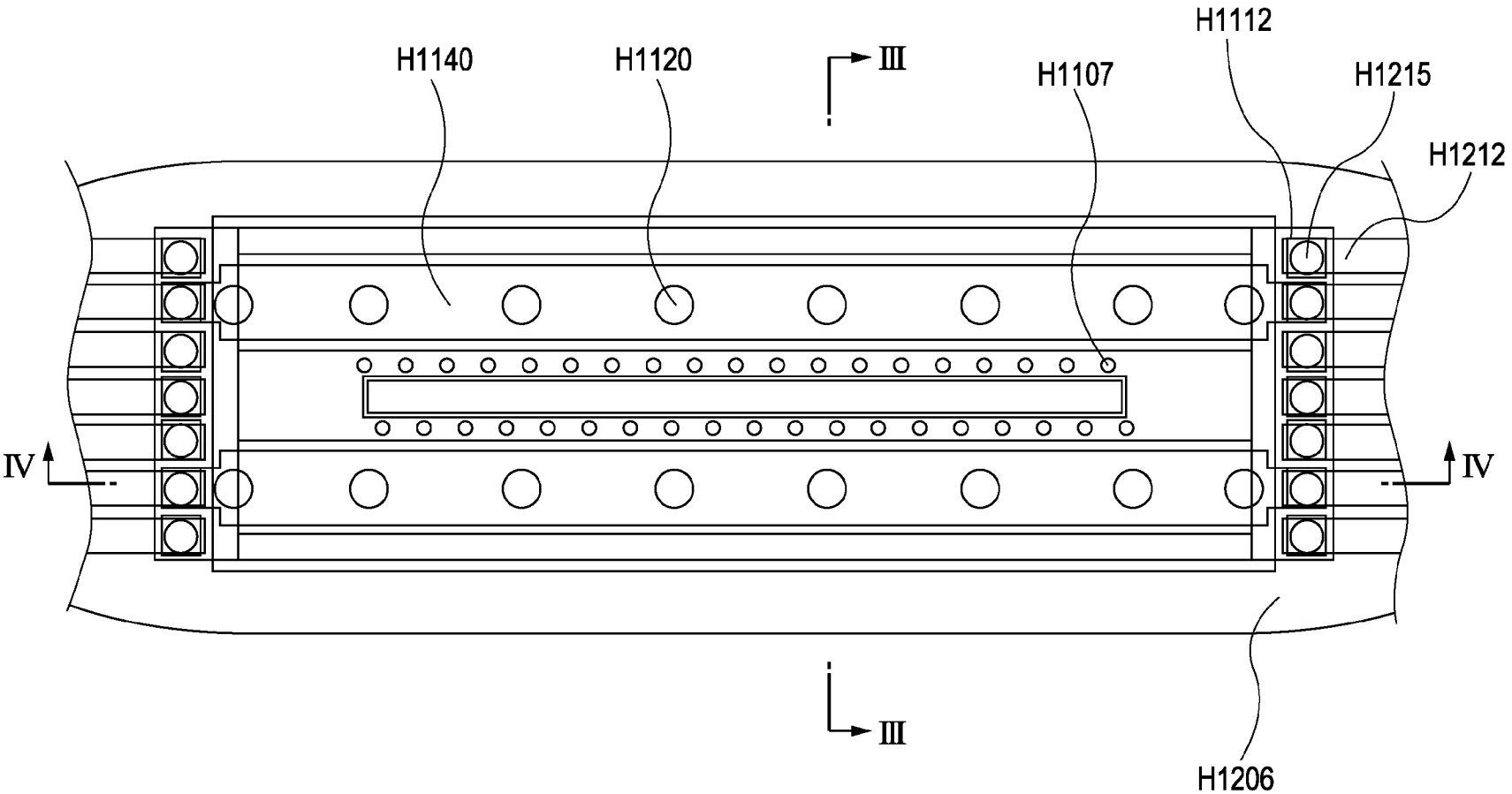
FIG. 2 is a perspective view of the ink-discharge substrate unit, shown in FIG. 1, mounted on an ink-discharge-recording-head main body, as seen from the front.

FIG. 2 is a perspective view of the ink-discharge substrate unit H1050, shown in FIG. 1, mounted on an ink-discharge-recording-head main body, as seen from the front. The ink-discharge substrate unit H1050 has a plurality of through electrodes H1120 used as first electrodes.

Figure 3:
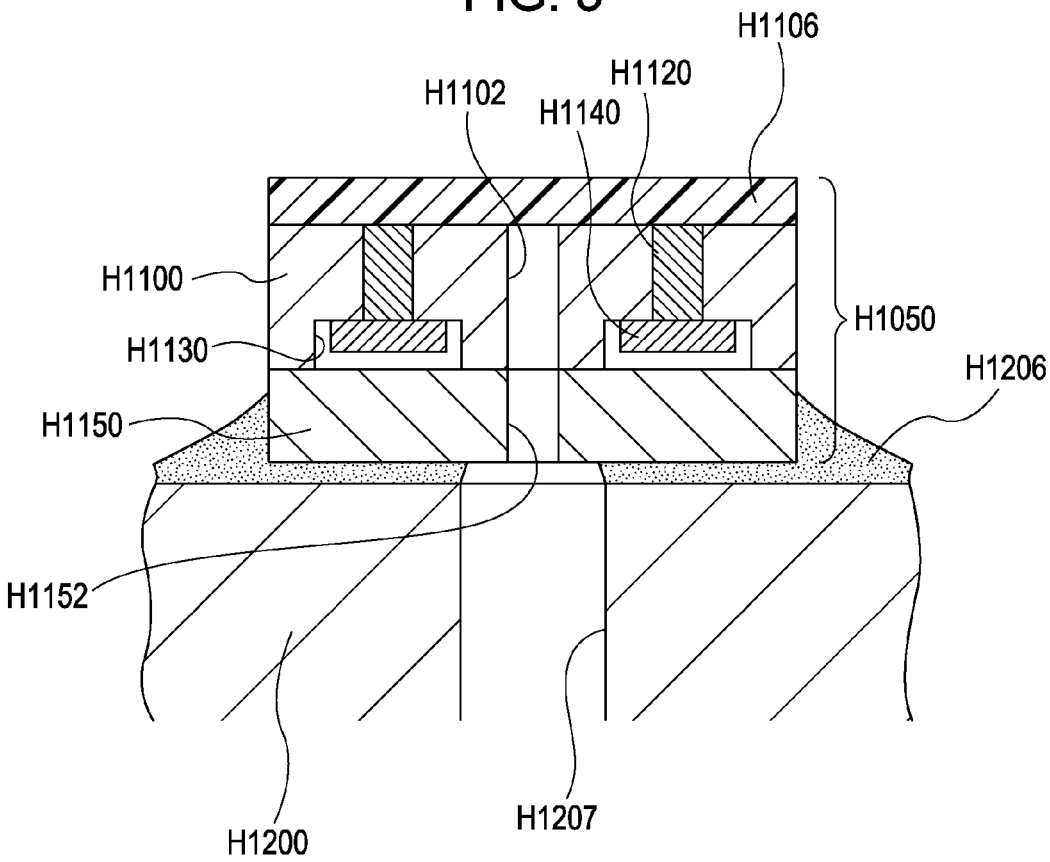
FIG. 3 is a cross-sectional view of the ink-discharge substrate unit and the vicinity thereof shown in FIG. 2, taken along line III-III'.

FIG. 3 is a cross-sectional view of the ink-discharge substrate unit H1050 and the vicinity thereof shown in FIG. 2, taken along line III-III'. The ink-discharge substrate unit H1050 is mounted on the support substrate H1200 of the ink-discharge-recording-head main body with a sealing member H1206 therebetween. The through electrodes H1120 are formed in the ink discharge substrate H1100 in such a manner as to pass through the ink discharge substrate H1100 from the back to the front and are electrically connected to the electrothermal transducers etc. on the front surface of the ink discharge substrate H1100.

The ink discharge substrate H1100 has depressions in the region of the back where the through electrodes are arranged. The depressions H1130 are provided with back electrodes H1140 used as second electrodes that electrically connect the arranged through electrodes H1120. The through electrodes H1120 and the back electrodes H1140 are electrically isolated from the ink discharge substrate H1100 since they are disposed with an insulator film between them and the ink discharge substrate H1100.

The depressions H1130 are formed by a method capable of accurate processing, for example, wet etching, dry etching, sandblasting, or grinding. The back electrodes H1140 are formed of, for example, plating or conductive paste.

Since the ink-discharge substrate unit H1050 has the back electrodes H1140 on the back surface of the ink discharge substrate H1100, sufficient space for wiring can be provided. Therefore, even if the size of the ink-discharge substrate unit is reduced, an increase in resistance can be prevented by forming electrodes in accordance therewith.

The width and thickness of the back electrodes H1140 are adjusted to the optimum resistance value of the ink-discharge substrate unit H1050. The optimum resistance value of the ink-discharge substrate unit H1050 can be obtained in accordance with the number of the electrothermal transducers H1103, required ink discharge characteristics, the recording speed of the ink discharge recording apparatus, the resistance values of the other parts of the ink discharge recording head, etc.

With the ink-discharge substrate unit H1050 according to this embodiment, the back electrodes H1140 are adjusted in a width of about 100 to 500 μm and a thickness of about 5 to 40 μm under the conditions that the recording width is 1 inch and the number of the electrothermal transducers H1103 is 1200.

The cover substrate H1150 opposes to the back surface of the ink discharge substrate H1100. The cover substrate H1150 is provided with an ink supply port H1152 similar to the ink supply port H1102 of the ink discharge substrate H1100. The ink supply port H1102 of the ink discharge substrate H1000 is supplied with ink from an ink supply port H1207 formed in the support substrate H1200 through the ink supply port H1152 of the cover substrate H1150.

The cover substrate H1150 is a silicon substrate similar to the ink discharge substrate H1100. The ink discharge substrate H1100 and the cover substrate H1150 are bonded by surface-activated room-temperature bonding. The surface-activated room-temperature bonding is a method of bonding the surfaces of two substrates by applying, for example, argon plasma in a vacuum to activate the surfaces and then applying low pressure to the surfaces at room temperature. The surface-activated room-temperature bonding method is suitable particularly for bonding substrates formed of the same kind of material.

The use of the surface-activated room-temperature bonding method can reduce the distortion of the bonded portions of the substrates, thereby preventing the deformation of the ink discharge substrate, and thus contributing to improving the quality of images formed by the ink discharge recording head. This also prevents the flow-passage forming member H1106 from peeling from the ink discharge substrate H1100. The surface-activated room-temperature bonding method also has a characteristic of being capable of accurate positioning at bonding, which is advantageous particularly for a compact ink discharge substrate.

The ink discharge substrate H1100 and the cover substrate H1150 can be bonded not by the surface-activated room-temperature bonding method but also by another method, such as an anode bonding method or a eutectic bonding method.

The ink discharge substrate H1100 and the cover substrate H1150 are bonded in the state of wafers and are cut into pieces by dicing after being bonded. This can reduce the number of process steps as compared with bonding after cutting the wafers into pieces, thereby reducing manufacturing costs. Furthermore, the bonding in the state of wafers improves the manufacturing yields of the ink-discharge substrate unit because of its high handling performance during bonding.

The back electrodes H1140 are accommodated in the space enclosed by the ink discharge substrate H1100 and the cover substrate H1150. Thus, the back electrodes H1140 are separated from the ink supply port H1102 by the ink discharge substrate H1100 and the cover substrate H1150. Accordingly, in the ink-discharge substrate unit H1050, electrical problems due to the contact of the back electrodes H1140 with ink can be prevented.

Since the clearance between the support substrate H1200 and the ink-discharge substrate unit H1050 is sealed by the sealing member H1206, leakage of ink from between the support substrate H1200 and the ink-discharge substrate unit H1050 can be prevented.

Figure 4:
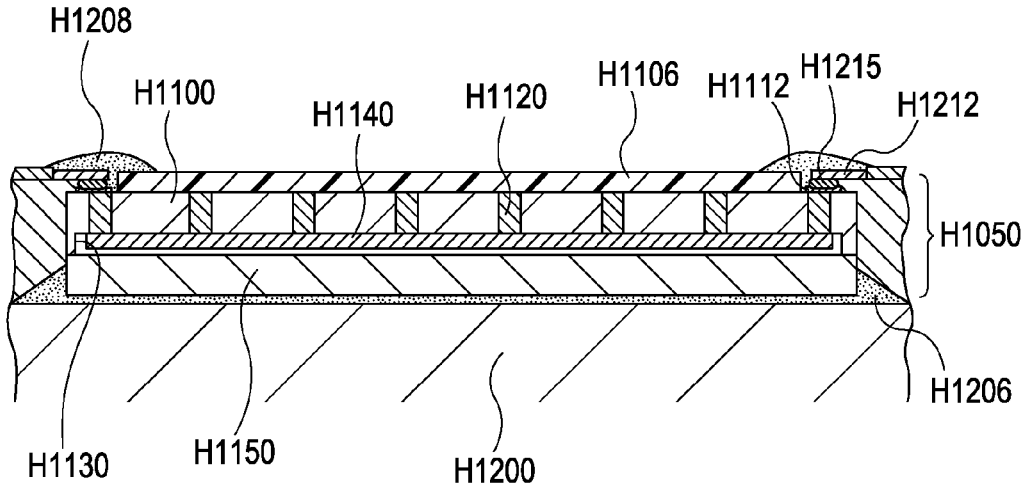
FIG. 4 is a cross-sectional view of the ink-discharge substrate unit and the vicinity thereof shown in FIG. 2, taken along line IV-IV'.

FIG. 4 is a cross-sectional view of the ink-discharge substrate unit H1050 and the vicinity thereof shown in FIG. 2, taken along line IV-IV'. Surface electrode terminals H1112 are provided on the through electrodes H1120 on both ends of the through electrodes H1120 arranged on the front surface of the ink discharge substrate H1100. The surface electrode terminals H1112 are electrically connected to electric terminals H1212 of the ink-discharge-recording-head main body through bumps H1215 by an ultrasonic bonding method, a heat press bonding method, or the like. Thus, the ink-discharge substrate unit H1050 and the ink-discharge-recording-head main body are electrically connected to allow transmission of electric control signals and supply of driving power from the ink-discharge-recording-head main body to the ink-discharge substrate unit H1050.

The surface electrode terminals H1112 can be connected to the electric terminals H1212 not by the bonding method using bumps but also by another method, such as electrode bonding method using gold electrodes. Thus, in the ink-discharge substrate unit H1050, the surface electrode terminals H1112 can be connected to the electric terminals H1212 of the ink-discharge-recording-head main body by an existing method, and therefore, good connection can be achieved without increased costs.

As shown in FIG. 2, some of the surface electrode terminals H1112 are connected to the through electrodes H1120, and the others are not connected thereto. The surface electrode terminals H1112 that are not connected to the through electrodes H1120 are connected to other electrodes (not shown) provided to transmit electric control signals or to supply driving power to the electrothermal transducers H1103 etc.

The electrical connecting portions at which the surface electrode terminals H1112 and the electric terminals H1212 are electrically connected through the bumps H1215 are covered with sealing members H1208 for protection. In the ink-discharge substrate unit H1050, there is no ink supply port in the vicinity of the surface electrode terminals H1112 disposed on the front surface of the ink discharge substrate H1100, so that problems in supplying ink are not caused by the sealing members H1208.

In the ink-discharge substrate unit H1050, there is no electrode terminal on the back surface thereof, so that no electrical problems occur due to adjustment of the amount of the sealing member H1206 between the ink-discharge substrate unit H1050 and the support substrate H1200. Accordingly, the ink-discharge substrate unit H1050 contributes to improving the reliability and manufacture yields of the ink discharge recording head.

Second Embodiment

Figure 5:
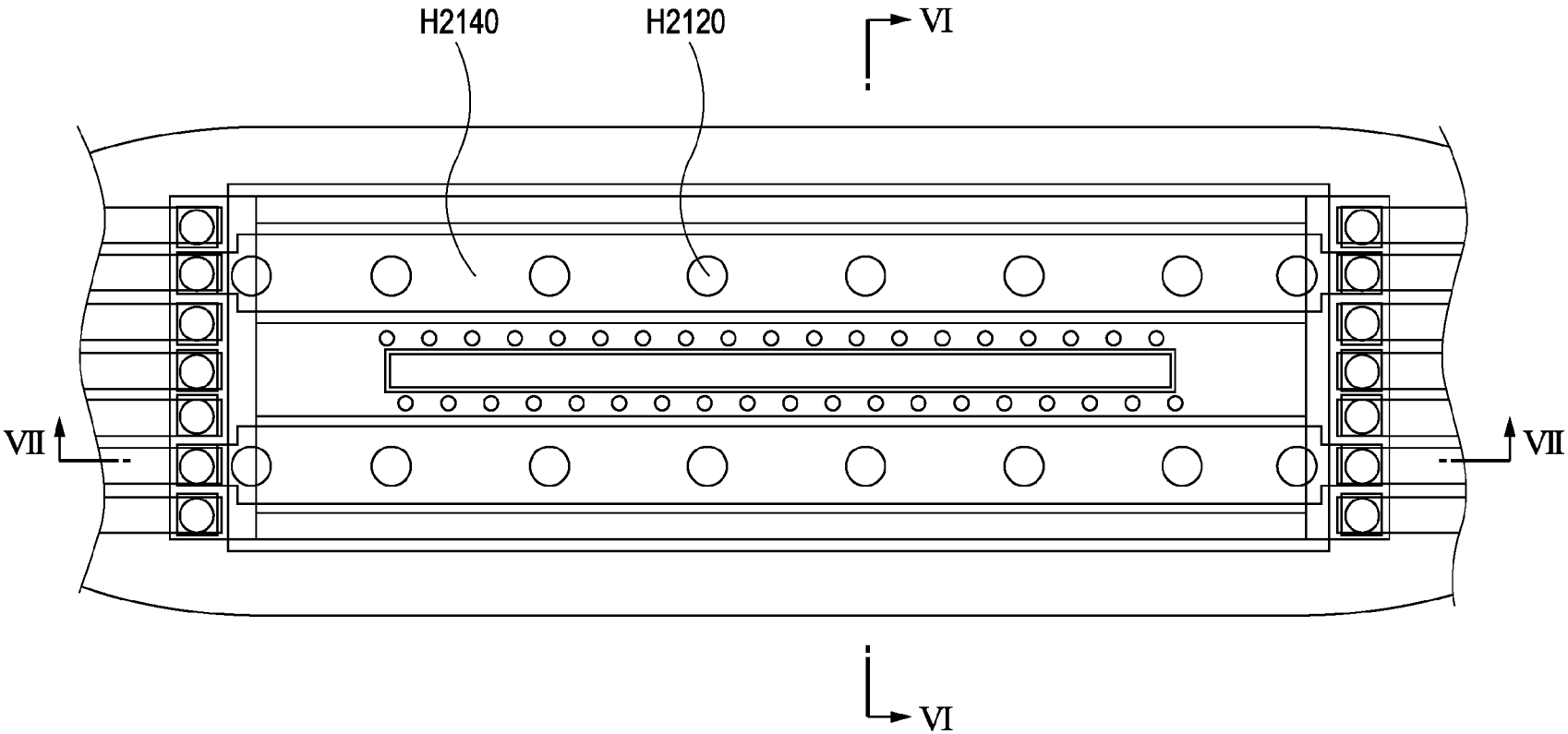
FIG. 5 is a perspective view of an ink-discharge substrate unit according to a second embodiment of the invention, mounted on the ink-discharge-recording-head main body, as viewed from the front.
Figure 6:
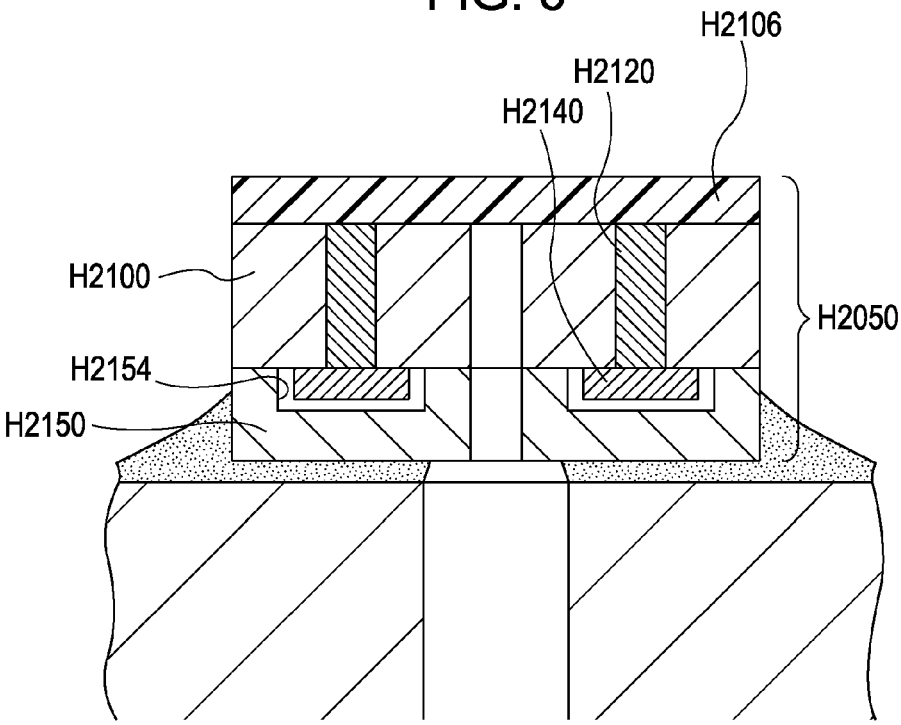
FIG. 6 is a cross-sectional view of the ink-discharge substrate unit and the vicinity thereof shown in FIG. 5, taken along line VI-VI'.
Figure 7:
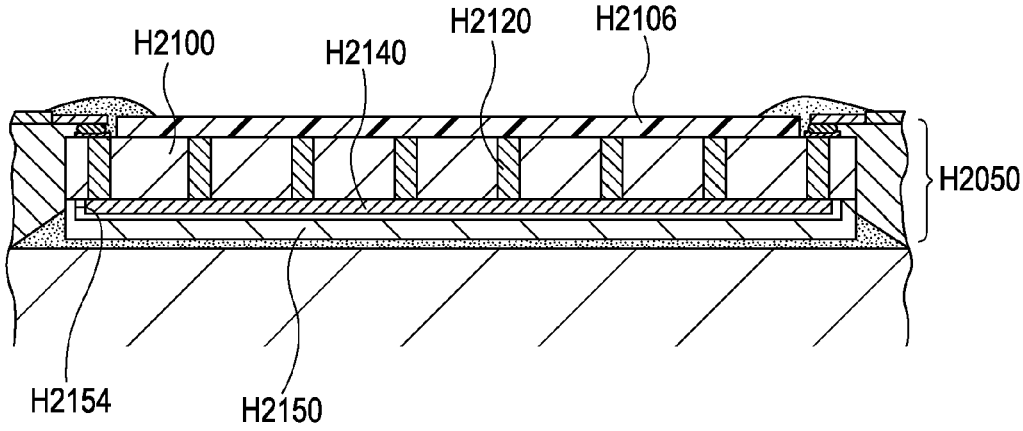
FIG. 7 is a cross-sectional view of the ink-discharge substrate unit and the vicinity thereof shown in FIG. 5, taken along line VII-VII'.

Referring next to FIGS. 5 to 7, an ink-discharge substrate unit H2050 according to a second embodiment of the invention will be described. FIG. 5 is a perspective view of the ink-discharge substrate unit H2050 according to the second embodiment of the invention, mounted on the ink-discharge-recording-head main body, as viewed from the front. The ink-discharge substrate unit H2050 according to this embodiment has a configuration similar to the ink-discharge substrate unit H1050 according to the first embodiment, other than the configuration shown below.

FIG. 6 is a cross-sectional view of the ink-discharge substrate unit H2050 and the vicinity thereof shown in FIG. 5, taken along line VI-VI'. FIG. 7 is a cross-sectional view of the same taken along line VII-VII'. Back electrodes H2140 are provided on the back of an ink discharge substrate H2100 of the ink-discharge substrate unit H2050 according to this embodiment. The back electrodes H2140 electrically connect the arranged through electrodes H2120.

Depressions H2154 are formed in a cover substrate H2150 opposing the back surface of the ink discharge substrate H2100. Since the back electrodes H2140 are accommodated in the depressions H2154 in the cover substrate H2150, the back electrodes H2140 are separated from the ink supply port by the ink discharge substrate H2100 and the cover substrate H2150. Accordingly, in the ink-discharge substrate unit H2050, electrical problems due to the contact of the back electrodes H2140 with ink can be prevented.

Although the depressions H1130 of the ink-discharge substrate unit H1050 according to the first embodiment are formed in the ink discharge substrate H1100, the depressions H2154 of the ink-discharge substrate unit H2050 according to this embodiment are formed in the cover substrate H2150.

Since an ink discharge substrate is provided with a flow-passage forming member, electrothermal transducers, electrical electrodes, etc., there are sometimes limitations in temperature and handling when forming depressions in the ink discharge substrate. In particular, if there is a need for forming depressions after forming a flow-passage forming member on the ink discharge substrate, the flow-passage forming member is sometimes peeled from the ink discharge substrate due to an increase in temperature when forming the depressions, because the flow-passage forming member is formed of resin.

In contrast, the ink-discharge substrate unit H2050 according to this embodiment is configured such that the depressions H2154 are formed in the cover substrate H2150 on which the flow-passage forming member etc. are not formed, and therefore, there are no limitation in temperature or handling when forming the depressions.

Third Embodiment

Figure 8:
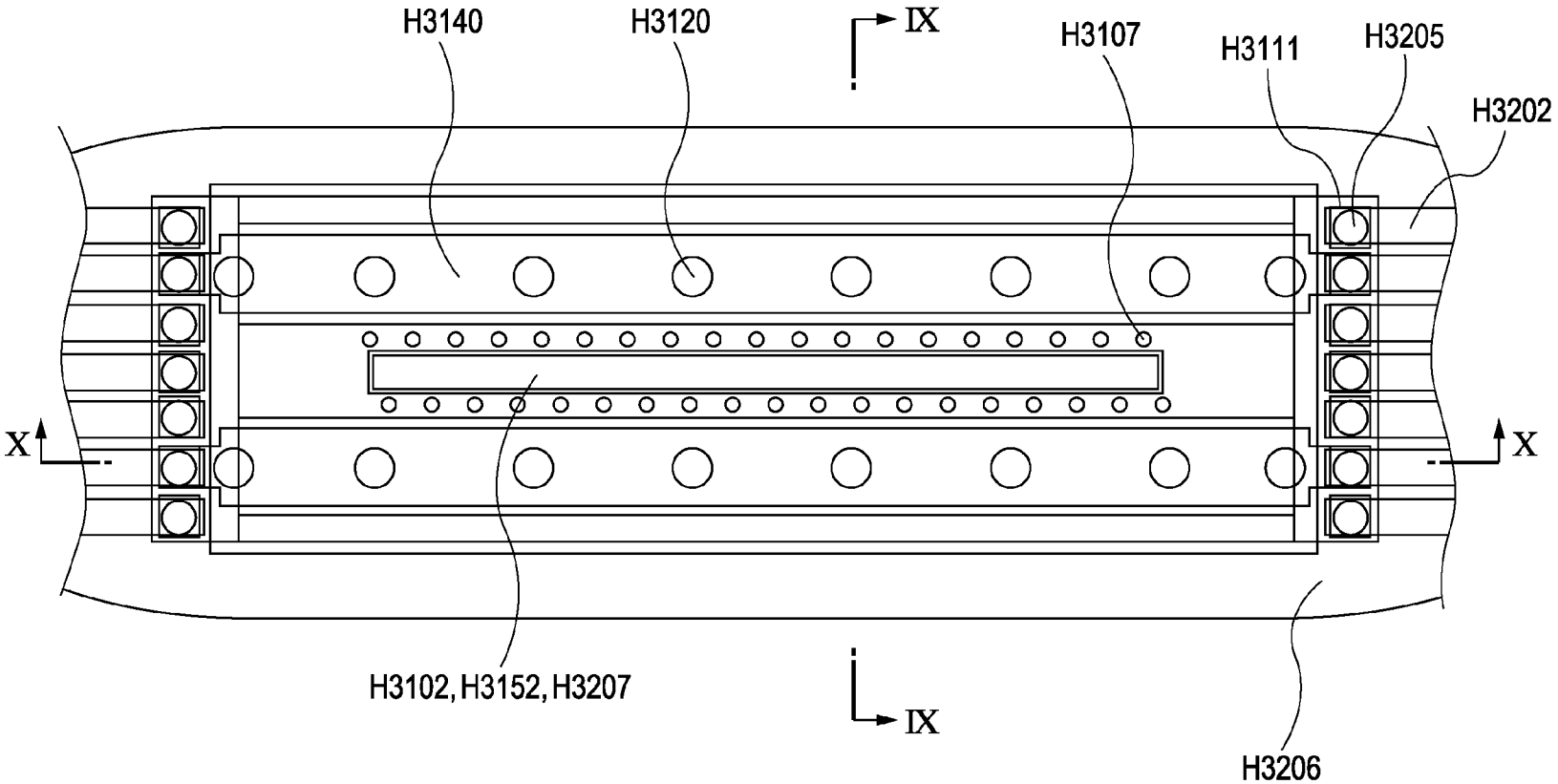
FIG. 8 is a perspective view of an ink-discharge substrate unit according to a third embodiment of the invention, mounted on the ink-discharge-recording-head main body, as viewed from the front.
Figure 9:
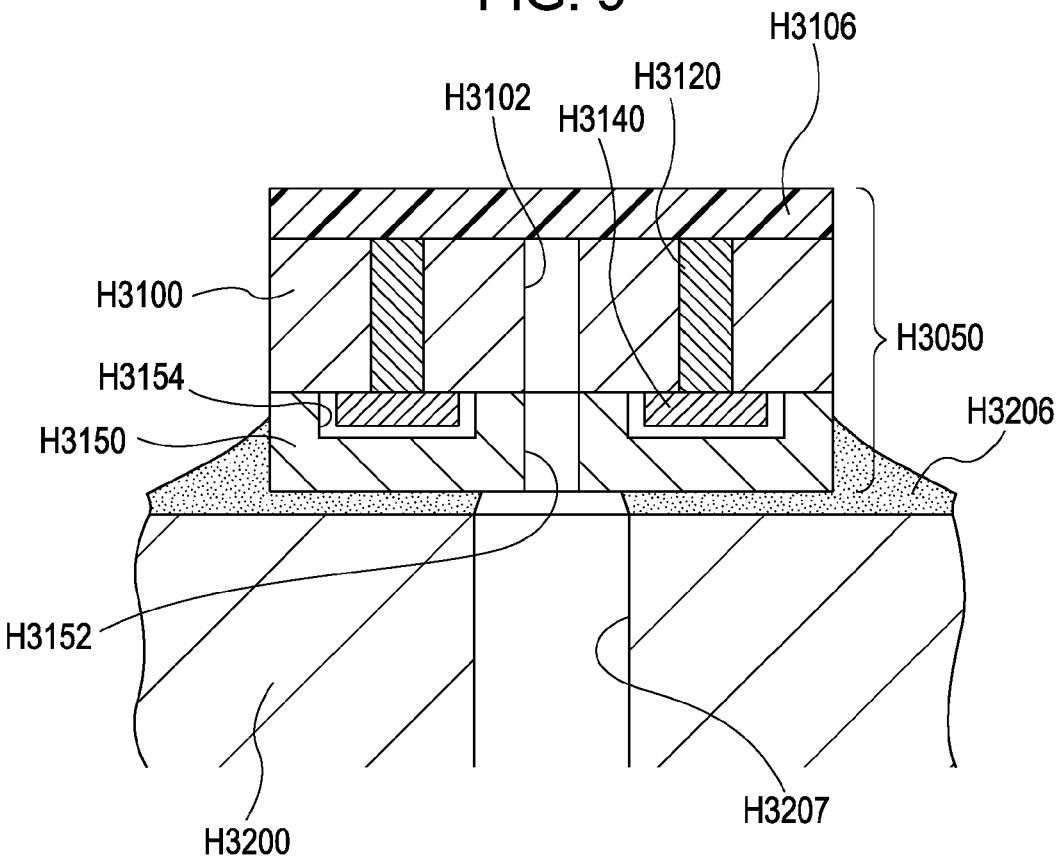
FIG. 9 is a cross-sectional view of the ink-discharge substrate unit and the vicinity thereof shown in FIG. 8, taken along line IX-IX'.
Figure 10:
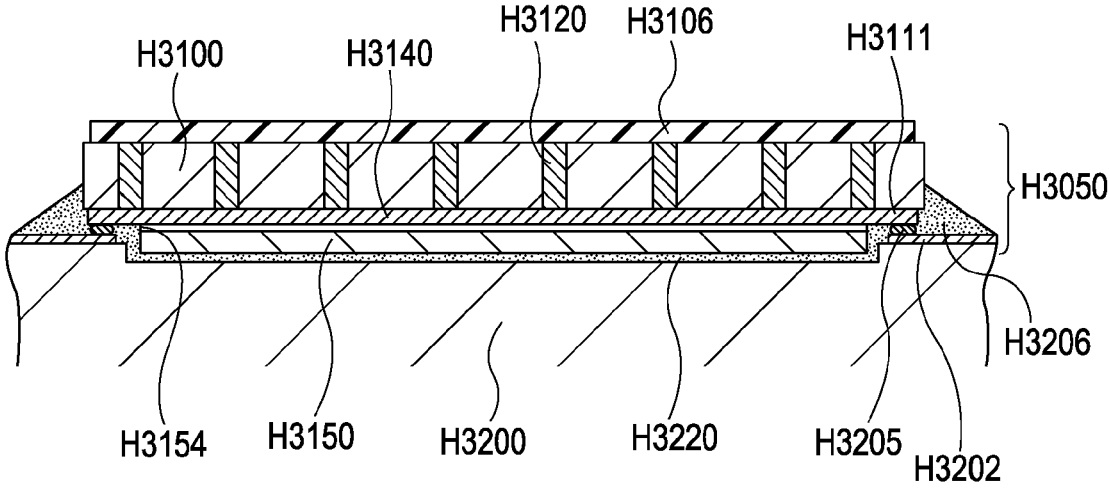
FIG. 10 is a cross-sectional view of the ink-discharge substrate unit and the vicinity thereof shown in FIG. 8, taken along line X-X'.

Referring next to FIGS. 8 to 10, an ink-discharge substrate unit H3050 according to a third embodiment of the invention will be described. FIG. 8 is a perspective view of the ink-discharge substrate unit H3050 according to the third embodiment of the invention, mounted on the ink-discharge-recording-head main body, as viewed from the front. The ink-discharge substrate unit H3050 according to this embodiment has a configuration similar to the ink-discharge substrate unit H1050 according to the first embodiment, other than the configuration shown below.

FIG. 9 is a cross-sectional view of the ink-discharge substrate unit H3050 and the vicinity thereof, shown in FIG. 8, taken along line IX-IX'. The ink-discharge substrate unit H3050 according to this embodiment is configured such that, as in the ink-discharge substrate unit H2050 according to the second embodiment, depressions H3154 are formed in a cover substrate H3150. Back electrodes H3140 arranged on the back surface of an ink discharge substrate H3100 are accommodated in the depression H3154 in the cover substrate H3150.

FIG. 10 is a cross-sectional view of the ink-discharge substrate unit H3050 and the vicinity thereof shown in FIG. 8, taken along line X-X'. The back electrodes H3140 have portions, at both ends in the arranging direction of the first electrodes H3120, not accommodated in the cover substrate H3150, and back electrode terminals H3111 are disposed at the portions.

The back electrode terminals H3111 are connected to electrode pads H3202 of the ink-discharge-recording-head main body through bumps H3205 by ultrasonic bonding, heat press bonding, or the like. Thus, the ink-discharge substrate unit H3050 and the ink-discharge-recording-head main body are electrically connected to allow transmission of electric control signals and supply of driving power from the ink-discharge-recording-head main body to the ink-discharge substrate unit H3050.

Part of a support substrate H3200, facing the cover substrate H3150, is provided with a recessed portion H3220. This prevents the cover substrate H3150 from coming into contact with the support substrate H3200 to interfere connection of the back electrode terminals H3111 with the electrode pads H3202.

As shown in FIG. 8, some of the surface electrode terminals H3112 are connected to the back electrodes H3140, and the others are not connected thereto. The back electrode terminals H3111 that are not connected to the back electrodes H3140 are connected to other electrodes (not shown) for transmitting control signals for the electrothermal transducers (not shown) via, for example, first electrodes (not shown) disposed at the ends of the ink-discharge substrate unit H3050.

The clearance between the support substrate H3200 and the ink-discharge substrate unit H3050 is sealed by a sealing member H3206, thereby preventing ink from leaking from between the support substrate H3200 and the ink-discharge substrate unit H1050.

Since the ink-discharge substrate unit H3050 is configured such that the electrode terminals H3111 are disposed on the back of the ink discharge substrate H3100, electrical connecting portions are disposed between the support substrate H3200 and the ink-discharge substrate unit H3050. Therefore, the sealing member 3206 also plays the roll of covering the electrical connecting portions for protection.

As shown in FIG. 8, the back electrode terminals H3111 are disposed both ends of the back electrodes H3140 and are away from ink supply ports H3102, H3152, and H3207. Therefore, even if the electrode terminals H3111 are disposed on the back surface of the ink-discharge substrate unit H3050, no electrical problems occur due contact of ink with the electrical connecting portions.

In the ink-discharge substrate unit H3050, the electrode terminals H3111 are disposed on the back surface of the ink discharge substrate H3100, so that there is no need for disposing a sealing member on the front surface having no electrode terminal. Therefore, the ink discharge surface of the ink-discharge substrate unit H3050 does not protrude due to disposition of a sealing member, thus allowing the interval between the discharge surface and a recording medium to be decreased. This contributes to improving the quality of images formed by the ink discharge recording head.

Furthermore, in ink-discharge substrate unit H3050, the discharge surface can be made flat without protruding due to a sealing member, thereby preventing the occurrence of problems when the discharge surface is wiped by a blade at a recovery operation of the ink discharge recording apparatus.

Fourth Embodiment

Figure 11:
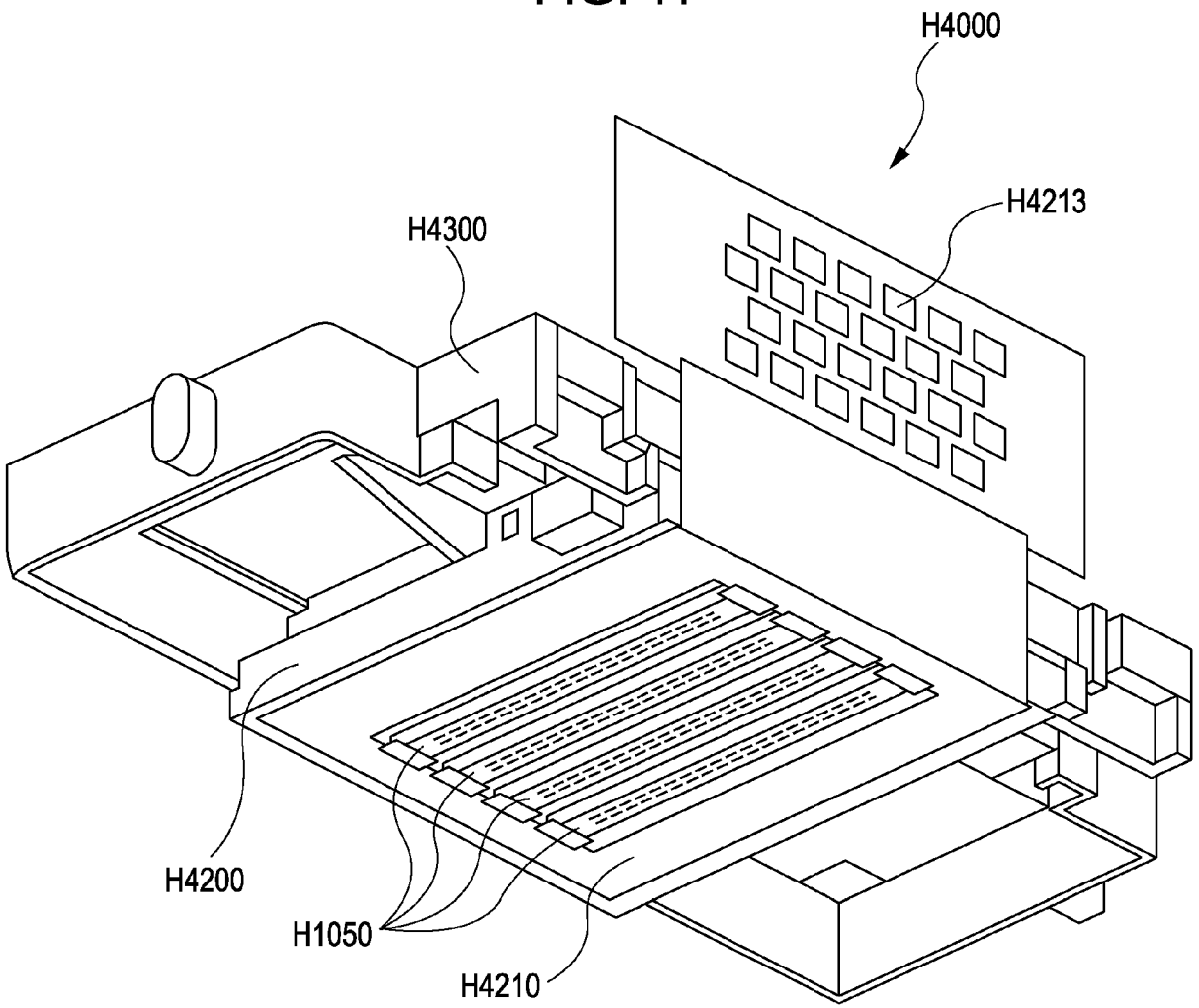
FIG. 11 is a perspective view of an ink discharge recording head according to a fourth embodiment of the invention.

Referring next to FIG. 11, an ink discharge recording head H4000 according to a fourth embodiment of the invention will be described. FIG. 11 is a perspective view of the ink discharge recording head H4000 according to the fourth embodiment of the invention.

The ink discharge recording head H4000 according to this embodiment can be applied to a general ink discharge recording apparatus. This can also be applied to other apparatuses, such as copying machines, facsimile machines equipped with a communication system, and word processors equipped with a recording unit, and to industrial composite recording units combined with various processing units.

In the ink discharge recording head H4000, a plurality of the ink-discharge substrate units H1050 according to the first embodiment (see FIGS. 1 to 4) are mounted to an ink-discharge-recording-head main body. The ink-discharge-recording-head main body according to this embodiment has a support substrate H4200 that supports the ink-discharge substrate units H1050. The support substrate H4200 is fitted with an ink supply member H4300 for supplying ink.

The ink-discharge-recording-head main body also has an electric member H4210 provided outside the front surface of the support substrate H4200, facing the ink-discharge substrate units H1050. The electric member H4210 is electrically connected to the surface electrode terminals H1112 of the ink-discharge substrate units H1050 (see FIG. 4). The electric member H4210 is constituted of a flexible board having, for example, one or two layers and transmits electric control signals or supplies driving power to the ink-discharge substrate units H1050. The surface of the electric member H4210 is covered with polyimide film.

In the ink discharge recording head H4000, ink that is supplied from ink tanks (not shown) to the ink supply member H4300 through a filter (not shown) is supplied to the ink-discharge substrate units H1050 through the ink supply ports (not shown) of the support substrate H4200.

The support substrate H4200 is formed of a material that is chemically stable against ink. It is desirable that the support substrate H4200 be formed of a material having a high thermal conductivity capable of releasing heat generated from the electrothermal transducers H1103 provided at the ink-discharge substrate units H1050 (see FIG. 1). Examples of a material for the support substrate H4200 include alumina ($Al_2O_3$), aluminum nitride (AlN), zirconia ($ZrO_2$), silicon nitride ($Si_3N_4$), silicon carbide (SiC), low-temperature co-fired ceramic (LTCC), and other ceramics. Other materials, such as mullite, silicon (Si), molybdenum (Mo), and tungsten (W), are also suitable.

The ink discharge recording head H4000 is mounted to the ink-discharge-recording-apparatus main body in such a manner that it is fixed by a positioning member of a carriage (not shown) provided at the ink-discharge-recording-apparatus main body. At that time, external connecting terminals H4213 provided on the ink-discharge-recording-head main body are electrically connected to the carriage. The carriage can be moved in the direction perpendicular to the recording-medium conveying direction. Ink tanks are detachably mounted to the ink discharge recording head H4000. The ink tanks can be replaced with new ink tanks when become empty of ink.

The ink-discharge substrate unit mounted to the main body of the ink discharge recording head H4000 according to this embodiment is not limited to a substrate unit in which the electrode terminals are mounted on the front surface as in the ink-discharge substrate unit H1050 according to the first embodiment. For example, it may be a substrate unit in which the electrode terminals are provided on the back surface, as in the ink-discharge substrate unit H3050 according to the third embodiment, provided that the electrode terminals are electrically connected to the electric member H4210.

Fifth Embodiment

Figure 12:
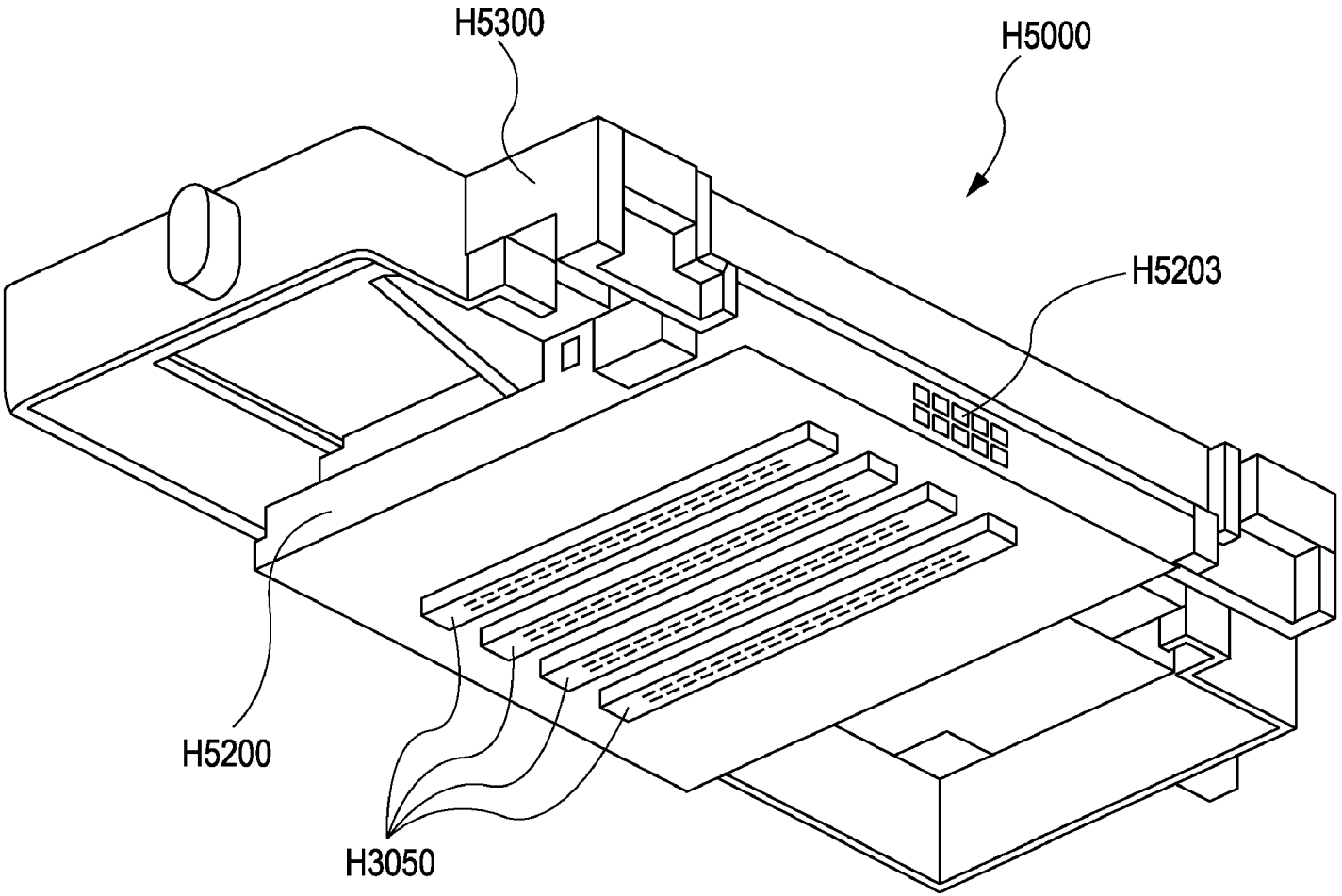
FIG. 12 is a perspective view of an ink discharge recording head according to a fifth embodiment of the invention.
Figure 13:
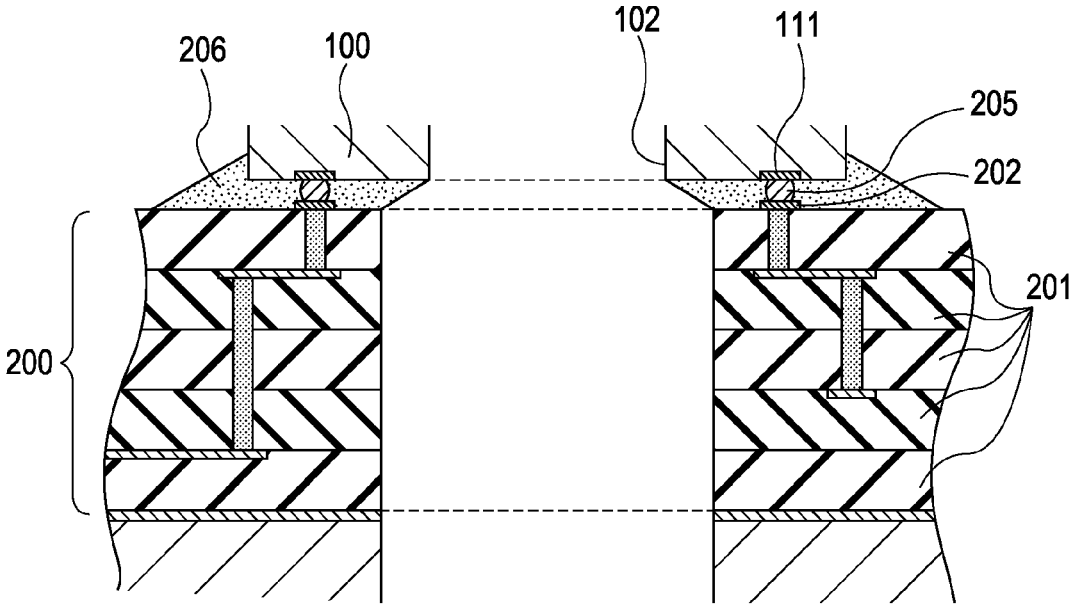
FIG. 13 is a cross-sectional view showing electrical connecting portions between a liquid discharge substrate and a support substrate of a related-art ink-discharge recording head and the vicinity thereof.

Referring next to FIG. 12, an ink discharge recording head H5000 according to a fifth embodiment of the invention will be described. FIG. 12 is a perspective view of the ink discharge recording head H5000 according to the fifth embodiment of the invention. The ink discharge recording head H5000 according to this embodiment is configured as in the ink discharge recording head H4000 according to the fourth embodiment, except the configuration below.

In the ink discharge recording head H5000, a plurality of the ink-discharge substrate units H3050 according to the third embodiments (see FIGS. 8 to 10) are mounted to an ink-discharge-recording-head main body. The ink-discharge-recording-head main body according to this embodiment has a support substrate H5200 that supports the ink-discharge substrate units H3050. The support substrate H5200 is fitted with an ink supply member H5300 for supplying ink.

The support substrate H5200 has, on the front surface and in the interior thereof, electric wires (not shown). The electric wires of the support substrate H5200 are electrically connected to the back electrode terminals H3111 of the ink-discharge substrate units H3050 (see FIG. 10). The electric wires of the support substrate H5200 are made of, for example, tungsten, molybdenum, platinum, gold, silver, copper, or a platinum-palladium alloy, and transmit electric control signals or supply driving power to the ink-discharge substrate units H3050. The support substrate H5200 has, at one side, external connecting terminals H5203 that are electrically connected to the carriage when the ink discharge recording head H5000 is mounted to the ink-discharge-recording-apparatus main body.

The ink-discharge substrate unit mounted to the main body of the ink discharge recording head H5000 according to this embodiment is not limited to a substrate unit in which the electrode terminals are provided on the back surface, as in the ink-discharge substrate unit H3050 according to the third embodiment. For example, it may be a substrate unit in which the electrode terminals are provided on the front surface, as in the ink-discharge substrate units H1050 and H2050 according to the first and second embodiments, provided that the electrode terminals are electrically connected to the electric wires of the support substrate H5200.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-146694 filed on Jun. 4, 2008, which is hereby incorporated by reference herein in its entirety.

What is claimed is:

1. A liquid discharge substrate comprising:

a first substrate having a plurality of elements, on a first surface, that generates energy for discharging liquid;

a plurality of first electrodes electrically passing from the first surface to a second surface of the first substrate opposite to the first surface, and each of the first electrodes connected to one of the plurality of elements;

a second substrate having a joint surface that is joined to the second surface of the first substrate, a recessed area being provided on the joint surface and forming a space between the first substrate and the second substrate; and a second electrode provided between the first substrate and the second substrate and located inside the space such that the second electrode does not contact the second substrate, and electrically connected to the plurality of first electrodes.

2. The liquid discharge substrate according to claim 1, wherein the second electrode is exposed at both ends along an arranging direction of the plurality of first electrodes.

3. The liquid discharge substrate according to claim 1, wherein the first substrate and the second substrate have a liquid supply port through which liquid is supplied.

4. The liquid discharge substrate according to claim 1, wherein the first substrate and the second substrate are formed of a material of the same composition.

5. The liquid discharge substrate according to claim 1, wherein the first substrate and the second substrate are bonded by surface-activated room-temperature bonding.

6. A liquid discharge head comprising the liquid discharge substrate according to claim 1.

7. The liquid discharge substrate according to claim 2, wherein the second electrode is electrically connected to terminals of a support substrate to support the liquid discharge substrate at the ends.

8. The liquid discharge substrate according to claim 2, wherein the second electrode is electrically connected to an electric member at the ends.

9. The liquid discharge substrate according to claim 3, wherein both the first substrate and the second substrate are formed of silicon.

* * * * *